US010347997B2

(12) United States Patent
Kayama et al.

(10) Patent No.: US 10,347,997 B2
(45) Date of Patent: Jul. 9, 2019

(54) TERMINAL-EQUIPPED ELECTRICAL WIRE AND WIRE HARNESS USING THE SAME

(71) Applicant: YAZAKI CORPORATION, Tokyo (JP)

(72) Inventors: Shinobu Kayama, Shizuoka (JP); Nobuyuki Tamura, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 40 days.

(21) Appl. No.: 15/265,886

(22) Filed: Sep. 15, 2016

(65) Prior Publication Data

US 2017/0085012 A1 Mar. 23, 2017

(30) Foreign Application Priority Data

Sep. 18, 2015 (JP) ..... 2015-186019

(51) Int. Cl.

| | |
|---|---|
| ***H01R 4/18*** | (2006.01) |
| ***H01R 4/62*** | (2006.01) |
| ***H01R 13/03*** | (2006.01) |
| ***H01R 13/533*** | (2006.01) |

(52) U.S. Cl.

CPC ..... *H01R 4/185* (2013.01); *H01R 4/62* (2013.01); *H01R 13/03* (2013.01); *H01R 13/533* (2013.01)

(58) Field of Classification Search

CPC . H01R 4/185; H01R 4/62; H01R 4/58; H01R 4/184; H01R 43/048

USPC ..... 439/866

See application file for complete search history.

(56) References Cited

U.S. PATENT DOCUMENTS

| | | | | |
|---|---|---|---|---|
| 2,906,987 A * | 9/1959 | Fox, Jr. | ..... | H01R 4/20 174/94 R |
| 4,648,679 A * | 3/1987 | Pelczarski | ..... | H01R 4/2466 439/400 |
| 4,885,215 A * | 12/1989 | Yoshioka | ..... | C25D 5/028 138/143 |
| 4,911,991 A | 3/1990 | Van Ooij | | |

(Continued)

FOREIGN PATENT DOCUMENTS

| | | |
|---|---|---|
| CN | 88101089 A | 10/1988 |
| CN | 101904061 A | 12/2010 |

(Continued)

OTHER PUBLICATIONS

An office action dated Aug. 2, 2018 in a counterpart Chinese patent application.

*Primary Examiner* — Jean F Duverne

(74) *Attorney, Agent, or Firm* — MetroLexis Law Group, PLLC

(57) ABSTRACT

A terminal-equipped electrical wire according to a first aspect of the present invention includes an electrical wire having a conductor and an electrical-wire coating member covering the conductor, and a crimp terminal having a crimp-terminal main body electrically connected to the conductor of the electrical wire, and an anticorrosive plating layer provided to a portion of a surface of the crimp-terminal main body, the portion being in contact with at least the conductor of the electrical wire. The conductor is made of aluminum or an aluminum alloy, and the anticorrosive plating layer is made of a Ni—Zn alloy having a Zn content of 69 to 78% by mass.

18 Claims, 6 Drawing Sheets

(56) References Cited

U.S. PATENT DOCUMENTS 5,225,066 A * 7/1993 Drew ..... C25D 7/0607 205/114
6,143,430 A * 11/2000 Miyasaka ..... C23C 28/023 148/264
6,397,896 B2 * 6/2002 Takahashi ..... B32B 15/013 138/137
6,613,603 B1 * 9/2003 Sano ..... H01L 31/022483 136/252
8,342,895 B2 * 1/2013 Yoshida ..... C25D 5/10 439/886
8,915,761 B2 * 12/2014 Kakuta ..... C23C 28/023 428/647
9,391,384 B2 * 7/2016 Kodama ..... H01R 4/62
9,711,875 B2 * 7/2017 Ooba ..... H01R 11/12
2001/0003687 A1 6/2001 Kondo
2006/0240272 A1 * 10/2006 Miura ..... B32B 15/017 428/607
2011/0225820 A1 9/2011 Kondo et al.
2011/0248389 A1 * 10/2011 Yorita ..... H01L 23/3677 257/659
2012/0021240 A1 * 1/2012 Urushihara ..... B23K 11/115 428/594
2013/0095708 A1 * 4/2013 Mitose ..... H01R 4/184 439/878
2013/0231013 A1 * 9/2013 Sato ..... H01R 4/185 439/878
2013/0252481 A1 9/2013 Sato et al.
2014/0206245 A1 7/2014 Sato
2014/0273667 A1 * 9/2014 Tachibana ..... H01R 43/048 439/877
2015/0020384 A1 * 1/2015 Yamamoto ..... H01R 4/185 29/863
2015/0027777 A1 * 1/2015 Drew ..... H01R 4/185 174/72 A
2015/0091206 A1 4/2015 Sato
2015/0287496 A1 * 10/2015 Sato ..... H01R 4/62 174/74 R
2016/0006134 A1 * 1/2016 Ohnuma ..... H01R 4/185 439/878
2016/0212836 A1 * 7/2016 Arai ..... C25D 1/04
2016/0365648 A1 * 12/2016 Aoki ..... H01R 4/185

FOREIGN PATENT DOCUMENTS

CN 103262349 A 8/2013
CN 103765681 A 4/2014
CN 104412453 A 3/2015
JP 2015-105408 A 6/2015

* cited by examiner

TERMINAL-EQUIPPED ELECTRICAL WIRE AND WIRE HARNESS USING THE SAME

CROSS REFERENCE TO RELATED APPLICATIONS

This application claims the priority of Japanese Patent Application No. 2015-186019, filed on Sep. 18, 2015, the entire content of which are incorporated herein by reference.

BACKGROUND

Technical Field

The present invention relates to a terminal-equipped electrical wire and a wire harness using the terminal-equipped electrical wire. More specifically, the present invention relates to a terminal-equipped electrical wire including an anticorrosive plating layer provided to a connection between a conductor of an electrical wire and a crimp terminal, and to a wire harness using the terminal-equipped electrical wire.

Related Art

Recently, from the viewpoint of improving fuel efficiencies through weight reduction of vehicles, aluminum has been increasingly used for a coated electrical wire constituting a wire harness in many cases. On the other hand, as a terminal fitting connected to such a coated electrical wire, generally used is a crimp terminal made of copper or a copper alloy excellent in electrical properties.

However, when an electrolyte solution such as salt water adheres to a contact portion, that is, a crimp portion, between the coated electrical wire and the crimp terminal, a corrosion, what is called galvanic corrosion, occurs due to the contact of different metal materials. This makes aluminum of the coated electrical wire likely to dissolve out. Moreover, when aluminum dissolves out in this manner, this makes it likely to increase the contact resistance between the crimp portion of the crimp terminal and the coated electrical wire, decrease the crimp strength, and cause other unfavorable outcomes.

SUMMARY

Hence, heretofore, a crimp portion between a coated electrical wire and a crimp terminal has been completely coated with an anticorrosive member made of a resin to keep an electrolyte solution from coming into contact with the crimp portion, thereby preventing galvanic corrosion at the crimp portion (refer to JP 2015-105408 A). However, in this method for completely coating a crimp portion with an anticorrosive member, the coated electrical wire and the crimp terminal are coated with the anticorrosive member, which is a member separate from the coated electrical wire and the crimp terminal, bringing about a problem of increasing the production costs of a wire harness and so on.

The present invention has been made in consideration of the above-described problems. An object of the present invention is to provide a terminal-equipped electrical wire capable of suppressing galvanic corrosion at a crimp portion between a coated electrical wire and a crimp terminal. Another object of the present invention is to provide a wire harness capable of suppressing galvanic corrosion at a crimp portion between a coated electrical wire and a crimp terminal.

A terminal-equipped electrical wire according to a first aspect of the present invention includes an electrical wire having a conductor and an electrical-wire coating member covering the conductor, and a crimp terminal having a crimp-terminal main body electrically connected to the conductor of the electrical wire, and an anticorrosive plating layer provided to a portion of a surface of the crimp-terminal main body, the portion being in contact with at least the conductor of the electrical wire. The conductor is made of aluminum or an aluminum alloy, and the anticorrosive plating layer is made of a Ni—Zn alloy having a Zn content of 69 to 78% by mass.

The crimp-terminal main body may be made of at least one selected from the group consisting of copper, copper alloys, and stainless steels.

A wire harness according to a second aspect of the present invention includes the terminal-equipped electrical wire according the first aspect.

The terminal-equipped electrical wire of the first aspect makes it possible to suppress galvanic corrosion at the crimp portion between the coated electrical wire and the crimp terminal. The wire harness of the second aspect makes it possible to suppress galvanic corrosion at the crimp portion between the coated electrical wire and the crimp terminal in the terminal-equipped electrical wire, so that a wire harness with high corrosion resistance is obtained.

DETAILED DESCRIPTION

Figure 1:
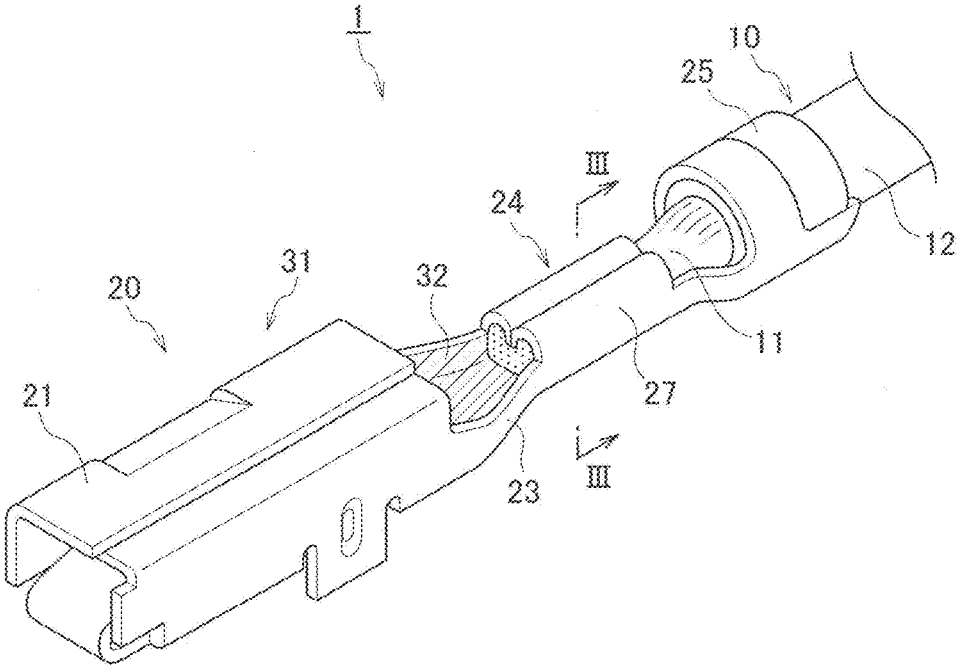
FIG. 1 is a perspective view showing a terminal-equipped electrical wire according to an embodiment of the present invention.

Hereinafter, a terminal-equipped electrical wire and a wire harness according to embodiments of the present invention will be described in detail with reference to the drawings. Note that the dimensional proportions in the drawings are exaggerated for convenience of description and are different from the actual proportions in some cases.

First Embodiment (Terminal-Equipped Electrical Wire)

Figure 2:
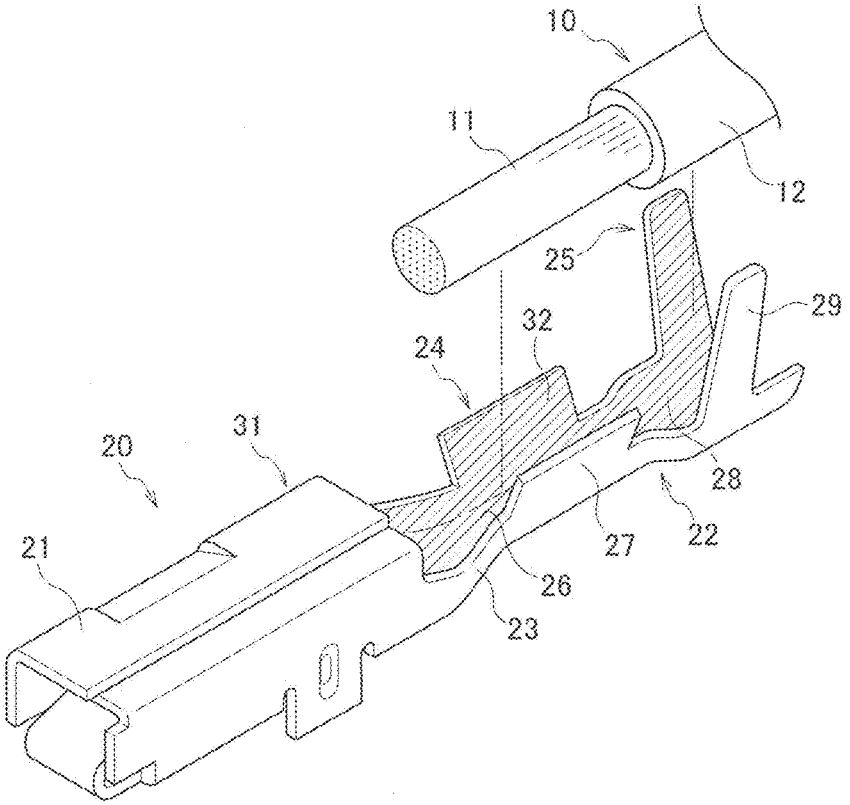
FIG. 2 is a perspective view showing a state of the terminal-equipped electrical wire shown in FIG. 1 before crimping between an electrical wire and a terminal.
Figure 3:
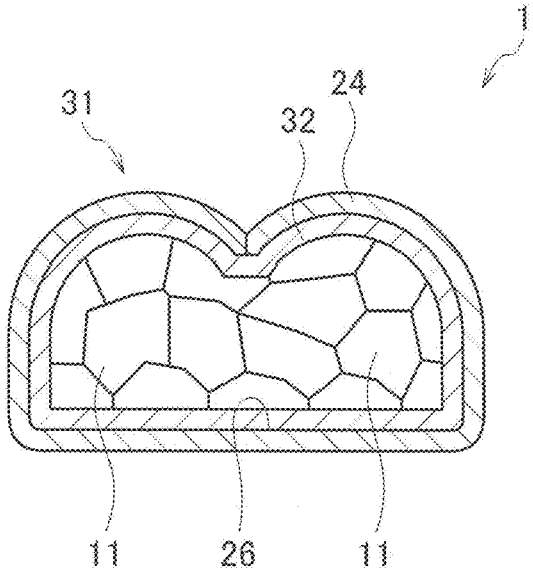
FIG. 3 is a cross-sectional view taken along the line III-III in FIG. 1.

As shown in FIGS. 1 to 3, a terminal-equipped electrical wire 1 of the present embodiment includes: an electrical wire 10 having an electrically conductive conductor 11 and an electrical-wire coating member 12 covering the conductor 11; and a crimp terminal 20 connected to the conductor 11 of the electrical wire 10.

(Electrical Wire)

The electrical wire 10 has the electrically conductive conductor 11 and the electrical-wire coating member 12 covering the conductor 11. As the material of the conductor 11, it is possible to use a metal having a high electrical conductivity, for example, copper, copper alloys, aluminum, aluminum alloys, and the like. Moreover, as the material of the conductor 11, it is also possible to use copper, copper alloys, aluminum, aluminum alloys, and the like whose surfaces are plated with tin. Note that, recently, wire harnesses have been demanded to be light in weight. For this reason, the conductor 11 is preferably made of aluminum or an aluminum alloy, which is light in weight, so that the weight reduction of the wire harness can be achieved.

As the material of the electrical-wire coating member 12 covering the conductor 11, it is possible to use a resin capable of ensuring electrical insulation, for example, olefin-based resins. Specifically, the material of the electrical-wire coating member 12 can contain, as the main component, at least one selected from the group consisting of polyethylene (PE), polypropylene (PP), ethylene copolymers, and propylene copolymers. Moreover, the material of the electrical-wire coating member 12 can contain, as the main component, polyvinyl chloride (PVC). Among these, polypropylene and polyvinyl chloride are preferable because of the high electrical insulation. Note that, herein, the main component refers to a component whose content is 50% by weight or more of the entire electrical-wire coating member, (Crimp Terminal)

The crimp terminal 20 is a female crimp terminal and has: a crimp-terminal main body 31 electrically connected to the conductor 11 of the electrical wire 10; and an anticorrosive plating layer 32 provided to a portion of a surface of this crimp-terminal main body, the portion being in contact with at least the conductor of the electrical wire 10. Herein, the crimp-terminal main body 31 indicates a portion of the crimp terminal 20 other than the anticorrosive plating layer 32 provided to the surface. The crimp terminal 20 and the conductor 11 of the electrical wire 10 are electrically connected, for example, by swaging the electrical wire 10 with the crimp terminal 20.

(Crimp-Terminal Main Body)

The crimp-terminal main body 31 of the crimp terminal 20 has an electrical connector 21 connected to an unillustrated counterpart terminal. The electrical connector 21 has a box shape and includes a spring piece configured to engage with the counterpart terminal. Further, an electrical wire connector 22 connected to an end portion of the electrical wire 10 by swaging is provided to an opposite side of the crimp-terminal main body 31 of the crimp terminal 20 to the electrical connector 21. The electrical connector 21 and the electrical wire connector 22 are connected to each other with a linker 23. Note that the electrical connector 21, the electrical wire connector 22, and the linker 23 are made of the same material and integrally form the crimp terminal 20, but each unit is named for convenience.

The electrical wire connector 22 includes a conductor crimper 24 configured to swage the conductor 11 of the electrical wire 10, and a coating member swager 25 configured to swage the electrical-wire coating member 12 of the electrical wire 10.

The conductor crimper 24 is in direct contact with the conductor 11 exposed by removing the electrical-wire coating member 12 from the end portion of the electrical wire 10, and has a bottom plate 26 and a pair of conductor swaging pieces 27. The pair of conductor swaging pieces 27 extend upward from both side edges of the bottom plate 26. The pair of conductor swaging pieces 27 are capable of swaging the conductor 11 in such a state that the conductor 11 is in close contact with an upper surface of the bottom plate 26, when the pair of conductor swaging pieces 27 are bent inward in such a manner as to wrap the conductor 11 of the electrical wire 10. The bottom plate 26 and the pair of conductor swaging pieces 27 form the conductor crimper 24 having a substantially U shape in a cross-sectional view.

The coating member swager 25 is in direct contact with the electrical-wire coating member 12 at the end portion of the electrical wire 10, and has a bottom plate 28 and a pair of coating member swaging pieces 29. The pair of coating member swaging pieces 29 extend upward from both side edges of the bottom plate 28. The pair of coating member swaging pieces 29 are capable of swaging the electrical-wire coating member 12 in such a state that the electrical-wire coating member 12 is in close contact with an upper surface of the bottom plate 28, when the pair of coating member swaging pieces 29 are bent inward in such a manner as to wrap the portion provided with the electrical-wire coating member 12. The bottom plate 28 and the pair of coating member swaging pieces 29 form the coating member swager 25 having a substantially U shape in a cross-sectional view. Note that the bottom plate 26 of the conductor crimper 24 and the bottom plate 28 of the coating member swager 25 are continuously formed as a common bottom plate.

The crimp-terminal main body 31 of the crimp terminal 20 includes the electrical connector 21, the electrical wire connector 22, the linker 23, the conductor crimper 24, the coating member swager 25, the bottom plate 26, the conductor swaging pieces 27, the bottom plate 28, the coating member swaging pieces 29, and so forth, as described above. Note that these members constituting the crimp-terminal main body 31 of the crimp terminal 20 may be separate members from each other, but are normally integrated and made of the same material.

As the material of the crimp-terminal main body 31 of the crimp terminal 20 (terminal material), it is possible to use a metal having a high electrical conductivity, for example, at least one selected from the group consisting of copper, copper alloys, and stainless steels. Note that, in the case where the crimp-terminal main body 31 is made of a single material, the material of the crimp-terminal main body 31 is copper, a copper alloy, or a stainless steel. In the case where the crimp-terminal main body 31 is made of two or more materials, it is possible to use two or more selected from the group consisting of copper, copper alloys, and stainless steels.

(Anticorrosive Plating Layer)

The anticorrosive plating layer 32 is a layer configured to suppress a corrosion, what is called galvanic corrosion, due to the contact of different metal materials at the contact portion (crimp portion) between the crimp-terminal main body 31 and the conductor 11 of the electrical wire 10. Galvanic corrosion is a phenomenon which occurs when an electrolyte solution such as salt water adheres to different metal materials in contact with each other, thereby dissolving one of the materials, for example, the material constituting the conductor 11. For example, in a case where the conductor 11 is made of aluminum or an aluminum alloy and the crimp-terminal main body 31 is made of at least one selected from the group consisting of copper, copper alloys, and stainless steels, when galvanic corrosion occurs, aluminum dissolves out from the conductor 11. In other words, the anticorrosive plating layer 32 is a layer configured to suppress, for example, the dissolution of aluminum from the conductor 11 due to galvanic corrosion.

Note that, heretofore, in the case where the conductor 11 is made of aluminum or an aluminum alloy and the crimp-terminal main body 31 is made of copper or a copper alloy, the surface of the copper or copper alloy constituting the crimp-terminal main body 31 has been plated with tin (Sn) so as to suppress galvanic corrosion. However, means having a galvanic-corrosion suppressing effect superior to tin (Sn) plating is industrially preferable. The anticorrosive plating layer 32 used in the present embodiment satisfies such a demand.

Since the anticorrosive plating layer 32 is a layer configured to suppress a corrosion due to the contact of different metal materials between the crimp-terminal main body 31 and the conductor 11, the anticorrosive plating layer 32 is provided to a portion of the surface of the crimp-terminal main body 31, the portion being in contact with at least the conductor 11 of the electrical wire 10.

As shown in FIGS. 1 to 3, in the first embodiment, the anticorrosive plating layer 32 is provided to the entire surfaces of the electrical wire connector 22, the linker 23, the conductor crimper 24, the coating member swager 25, the bottom plate 26, the conductor swaging pieces 27, the bottom plate 28, and the coating member swaging pieces 29, the surfaces all facing the conductor 11 of the electrical wire 10. Nevertheless, since the anticorrosive plating layer 32 should be able to suppress galvanic corrosion due to the contact between the crimp-terminal main body 31 and the conductor 11, it is only necessary to provide the anticorrosive plating layer 32 to the portion of the surface of the crimp-terminal main body 31, the portion being in contact with at least the conductor 11 of the electrical wire 10. For example, the anticorrosive plating layer 32 may be provided only to portions of the conductor crimper 24 and the bottom plate 26, the portions being in contact with the conductor 11 of the electrical wire 10. In this case, it is possible to reduce the area of the anticorrosive plating layer 32, and thereby reduce the production cost. Note that the anticorrosive plating layer 32 may be formed on the entire surface of the crimp-terminal main body 31. In this case, the anticorrosive plating layer 32 is formed on the surface of the crimp-terminal main body 31 simply by immersing the crimp-terminal main body 31 for the plating. This facilitates the production of the crimp-terminal main body 31 with the anticorrosive plating layer 32 formed thereon, that is, the crimp terminal 20.

The anticorrosive plating layer 32 is made of a Ni—Zn alloy. The Ni—Zn alloy has a Zn content of 69 to 78% by mass. This preferably increases the effect of suppressing galvanic corrosion in comparison with the conventional tin (Sn) plating of the copper or copper alloy surface. This is conceivably because if the Zn content is within the above-described range, the Ni—Zn alloy has fine crystal grains, which suppresses the corrosion. Specifically, it is conceivable that the fine crystal grains increases the area of the grain boundaries, thereby causing grain boundary scattering and increasing the electrical resistance, so that the galvanic corrosion current is decreased to suppress the corrosion.

On the other hand, if the Zn content is less than 69% by mass, this may lower the effect of suppressing galvanic corrosion in comparison with the conventional tin (Sn) plating of the copper or copper alloy surface. Meanwhile, if the Zn content exceeds 78% by mass, this may promote the corrosion of the Ni—Zn alloy plating itself. The composition of the Ni—Zn alloy constituting the anticorrosive plating layer 32 can be specified, for example, by analyzing the anticorrosive plating layer 32 using a scanning electron microscope (SEM) and energy-dispersive X-ray spectroscopy (EDX).

The anticorrosive plating layer 32 is polycrystalline and contains many crystal grains of the Ni—Zn alloy. The crystal grains constituting the anticorrosive plating layer 32 have an average crystal grain of normally 0.1 to 0.7 μm, preferably 0.2 to 0.5 μm. Herein, the term average crystal grain refers to an average value of diameters of ten crystal grains, the diameters being calculated from areas of the crystal grains obtained by capturing the surface of the anticorrosive plating layer 32 by scanning ion microscopy (SIM). The average crystal grain is preferably 0.1 to 0.7 μm because the effect of suppressing galvanic corrosion is high.

(Method for Forming Anticorrosive Plating Layer)

The anticorrosive plating layer 32 can be formed by plating, with a Ni—Zn alloy, the portion of the surface of the crimp-terminal main body 31, the portion being in contact with at least the conductor 11 of the electrical wire 10.

For example, zinc is mixed with a Watts bath known as a Ni plating bath to prepare a Ni—Zn alloy plating bath. Into this Ni—Zn alloy plating bath, the crimp-terminal main body 31 is immersed for the plating, so that the anticorrosive plating layer 32 can be formed. The plating is preferably carried out by constant-current electrolysis because the film thickness is controlled easily.

(Method for Manufacturing Terminal-Equipped Electrical Wire)

The crimp terminal 20 can be manufactured, for example, as follows. First of all, as shown in FIG. 2, the end portion of the electrical wire 10 is inserted into the electrical wire connector 22 of the crimp terminal 20. Thereby, the conductor 11 of the electrical wire 10 is placed on an upper surface section of the anticorrosive plating layer 32 formed on the bottom plate 26 of the conductor crimper 24, and the portion of the electrical wire 10 provided with the electrical-wire coating member 12 is placed on an upper surface section of the anticorrosive plating layer 32 formed on the bottom plate 28 of the coating member swager 25. Next, the electrical wire connector 22 and the end portion of the electrical wire 10 are pressed to deform the conductor crimper 24 and the coating member swager 25. Specifically, the pair of conductor swaging pieces 27 of the conductor crimper 24 are bent inward in such a manner as to wrap the conductor 11, so that the conductor 11 is swaged in such a state that the conductor 11 is in close contact with the upper surface of the bottom plate 26 with the anticorrosive plating layer 32 interposed therebetween. Further, the pair of coating member swaging pieces 29 of the coating member swager 25 are bent inward in such a manner as to wrap the portion provided with the electrical-wire coating member 12, so that the electrical-wire coating member 12 is swaged in such a state that the electrical-wire coating member 12 is in close contact with the upper surface of the bottom plate 28. In this manner, the crimp terminal 20 and the electrical wire 10 can be connected to each other by crimping.

(Effects of Terminal-Equipped Electrical Wire)

The terminal-equipped electrical wire of the present embodiment makes it possible to suppress galvanic corrosion at the crimp portion between the coated electrical wire and the crimp terminal. Moreover, since the anticorrosive plating layer 32 can be formed only at the portion of the surface of the crimp-terminal main body 31 in contact with the conductor 11 of the electrical wire 10, it is possible to reduce the production cost of the terminal-equipped electrical wire.

(Wire Harness)

The wire harness of the present embodiment includes the above-described terminal-equipped electrical wire. Specifically, as shown in FIG. 4, a wire harness 2 of the present embodiment includes a connector 40 and the above-described terminal-equipped, electrical wire 1.

Figure 4:
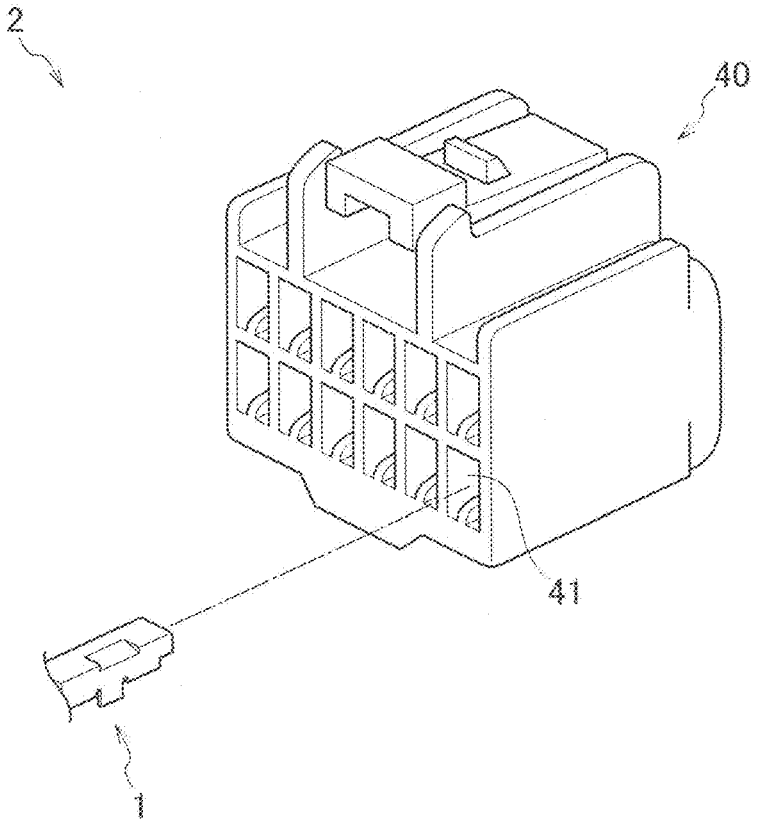
FIG. 4 is a perspective view showing a wire harness according to an embodiment of the present invention.

In FIG. 4, a back surface side of the connector 40 is provided with multiple unillustrated counterpart terminal attachments to which unillustrated counterpart terminals are to be attached. In FIG. 4, a front surface side of the connector 40 is provided with multiple cavities 41 to which the crimp terminal 20 of the terminal-equipped electrical wire 1 is to be attached. Each of the cavities 41 is provided with a substantially rectangular opening so that the crimp terminal 20 of the terminal-equipped electrical wire 1 can be attached thereto. Further, the opening of each cavity 41 is formed slightly larger than the cross section of the crimp terminal 20 of the terminal-equipped electrical wire 1. When the crimp terminal 20 of the terminal-equipped electrical wire 1 is attached to the cavity 41 of the connector 40, the unillustrated electrical wire of the terminal-equipped electrical wire 1 leads out from the front surface side of the connector 40 in FIG. 4.

(Effects of Wire Harness)

The wire harness of the present embodiment makes it possible to suppress galvanic corrosion at the crimp portion between the coated electrical wire and the crimp terminal in the terminal-equipped electrical wire, so that a wire harness with high corrosion resistance is obtained. Moreover, since the anticorrosive plating layer 32 can be formed in the terminal-equipped electrical wire only at the portion of the surface of the crimp-terminal main body 31 in contact with the conductor 11 of the electrical wire 10, it is possible to reduce the production cost of the wire harness.

EXAMPLES

Hereinafter, the present invention will be described in more details by way of Example, Comparative Examples, and Reference Example. However, the present invention is not limited to these examples.

Example 1

(Preparation of Crimp-Terminal Main Body)

The crimp-terminal main body 31 having a shape shown in FIG. 2 and made of pure copper (C1020-H) was prepared.

(Preparation of Plating Bath)

A plating bath was prepared by adding metal zinc to a Watts bath. Specifically, first of all, a Watts bath containing 240 g/l of nickel sulfate, 45 g/l of nickel chloride, and 30 g/l of boric acid was prepared. Next, metal zinc in an amount shown in Table 1 was dissolved in 10% by mass HCl. Further, 52 ml of the obtained aqueous solution of zinc chloride was added to 500 ml of the Watts bath. Thus, a zinc-containing Watts bath was prepared. The zinc and nickel contents of the zinc-containing Watts bath were determined such that when an anticorrosive plating layer was formed by plating the crimp-terminal main body made of pure copper under the electrolysis conditions shown in Table 1, the mass ratio of Zn—Ni constituting the obtained anticorrosive plating layer took values (i.e., 22% Ni and 78% Zn by mass) shown in the column of Example 1 in Table 1, Table 1 shows the composition of the plating bath.

TABLE 1

| | | Example 1 | Comparative Example 1 | Comparative Example 2 | Comparative Example 3 |
|---|---|---|---|---|---|
| Electrolysis conditions | base material (plated member) | copper (C1020-H) | copper (C1020-H) | copper (C1020-H) | copper (C1020-H) |
| | plating bath type | Watts bath (nickel sulfate: 240 g/l, nickel chloride: 45 g/l, boric acid: 30 g/l) | Watts bath (nickel sulfate: 240 g/l, nickel chloride: 45 g/l, boric acid: 30 g/l) | Watts bath (nickel sulfate: 240 g/l, nickel chloride: 45 g/l, boric acid: 30 g/l) | Watts bath (nickel sulfate: 240 g/l, nickel chloride: 45 g/l, boric acid: 30 g/l) |
| | additive | metal zinc | metal zinc | metal zinc | none |
| | added amount [g] | 2.734 | 0.847 | 0.2158 | — |
| | current [A] | 1.44 | 1.44 | 1.44 | 0.30 |
| | time [min] | 5 | 10 | | |
| | plating bath temperature [° C.] | 55 | 55 | 55 | 55 |
| Anticorrosive plating layer | composition [% by mass] | 22% Ni and 78% Zn by mass | 82% Ni and 18% Zn by mass | 93% Ni and 7% Zn by mass | 100% Ni by mass |

(Formation of Anticorrosive Plating Layer)

Next, the crimp-terminal main body 31 was immersed in the plating bath and subjected to constant-current electrolysis under the conditions shown in Table t to form an anticorrosive plating layer on the crimp-terminal main body 31. The specific plating procedure was as follows.

First of all, an electrolytic cell capable of immersing the crimp-terminal main body 31, a direct-current power supply, and a potentiostat/galvanostat (Solartron 1287 manufactured by TOYO Corporation) were prepared. The electrolytic cell was filled with the plating bath shown in Table 1.

Next, the crimp-terminal main body 1, which is a plated member, was washed by alkali degreasing, and immersed in 10% sulfuric acid for 2 minutes for pickling, followed by water washing. This crimp-terminal main body 31 was connected to a negative pole of the direct-current power supply by wiring. On the other hand, two nickel plates were connected to a positive pole of the direct-current power supply by wiring. The nickel plates were used to keep the nickel concentration in the plating bath constant.

The crimp-terminal main body 31 and the nickel plates were immersed in the plating bath inside the electrolytic cell. The crimp-terminal main body 31 was disposed in the plating bath in such a manner as to be located between the two nickel plates. Then, using the potentiostat/galvanostat, constant-current electrolysis was carried out under the conditions shown in Table 1. After the electrolysis was completed, the crimp-terminal main body 31 was taken out from the plating bath, and washed with water. As a result, the crimp terminal 20 was obtained in which the anticorrosive plating layer 32 was formed on the entire surface of the crimp-terminal main body 31. The anticorrosive plating layer 32 had a thickness of 2 μm.

(Evaluation of Anticorrosive Plating Layer)

(Composition of Anticorrosive Plating Layer)

The obtained anticorrosive plating layer 32 was analyzed for the elemental composition using a scanning electron microscope (SEM) and energy-dispersive X-ray spectroscopy (EDX). As a result, the material of the anticorrosive plating layer was a Ni—Zn alloy of 22% Ni and 78% Zn by mass. Table 1 shows the measurement result.

(Formation of Terminal-Equipped Electrical Wire)

The crimp terminal 20 including the anticorrosive plating layer 32 thus formed and the electrical wire 10 including an aluminum wire as a conductor were used to prepare the terminal-equipped electrical wire 1. Specifically, as shown in FIG. 2, the anticorrosive plating layer 32 of the crimp terminal 20 and the electrical wire 10 were disposed in such a manner as to face each other, and the conductor 11 of the electrical wire 10 was swaged with the pair of conductor swaging pieces 27 of the crimp terminal 20 while the electrical-wire coating member 12 of the electrical wire 10 was swaged with the pair of coating member swaging pieces 29 of the crimp terminal 20. Thus, the terminal-equipped electrical wire 1 shown in FIG. 1 was prepared.

(Aluminum Corrosion Rate in Galvanic Corrosion of Terminal-Equipped Electrical Wire)

In the terminal-equipped electrical wire 1, the anticorrosive plating layer 32 made of the Ni—Zn alloy on the surface of the crimp terminal 20 is in contact with the aluminum-made conductor 11 of the electrical wire 10, and galvanic corrosion may occur between the two. Hence, a Ni—Zn alloy test piece, which is the material of the anticorrosive plating layer 32, and a pure Al test piece made of aluminum, which is the material of the conductor 11, were used to calculate the aluminum corrosion rate in galvanic corrosion.

[Measurement of Spontaneous Potential]

Specifically, first of all, spontaneous potentials SP of a pure Al test piece and a Ni—Zn alloy test piece of 22% Ni and 78% Zn by mass, which is the material of the anticorrosive plating layer 32 of Example 1, were measured in an electrolyte solution. To be more specific, the spontaneous potentials were measured in 3% by mass of a NaCl aqueous solution of 25° C. using a silver-silver chloride electrode as a reference electrode. As a result, the pure Al test piece has a spontaneous potential $SP_{Al}$ of −0.794 [V vs. Ag—AgCl], and the Ni—Zn alloy test piece of 22% Ni and 78% Zn by mass had a spontaneous potential $SP_{22\%\ Ni\text{-}78\%\ Zn}$ of −0.672 [V vs. Ag—AgCl].

(Creation of Polarization Curves)

Next, polarization curves PC of the pure Al test piece and the Ni—Zn alloy test piece of 22% Ni and 78% Zn by mass, which is the material of the anticorrosive plating layer 32 of Example 1, in an electrolyte solution were determined. To be more specific, an anode polarization curve APC and a cathode polarization curve CPC were determined respectively for the pure Al test piece and the Ni—Zn alloy test piece of 22% Ni and 78% Zn by mass by the experiment in 3% by mass of a NaCl aqueous solution of 25° C.

The anode polarization curve APC and the cathode polarization curve CPC will be described. Polarization curves include an anode polarization curve APC obtained when a measurement sample is polarized from the spontaneous potential SP toward higher potential; and a cathode polarization curve CPC obtained when a measurement sample is polarized from SP toward lower potential. Both of the anode polarization curve and the cathode polarization curve can be drawn in a graph in Which the horizontal axis represents potential (V) and the vertical axis represents current density ($A/cm^2$) (hereinafter referred to as "P-d graph"). Specifically, an anode polarization curve of a substance X is drawn in a P-d graph as an anode polarization curve APCx of the substance X. The anode polarization curve APCx starts from a spontaneous potential value SPx of the substance X (the value is located on the horizontal axis of the P-d graph, where the current density is zero,) and extends from this SPx toward higher potential and in a direction in which the current density increases. Meanwhile, a cathode polarization curve of the substance X is drawn as a cathode polarization curve CPCx of the substance X, which extends toward lower potential than SPx and in a direction in which the current density increases.

When concretely measured, an anode polarization curve $APC_{Al}$ of the pure Al test piece was a curve starting from −0.794 [V vs. Ag—AgC] (i.e., the spontaneous potential $SP_{Al}$ value on the horizontal axis of the P-d graph) and extending toward higher potential than this value and in a direction in which the current density increases. Meanwhile, a cathode polarization curve $CPC_{Al}$ of the pure Al test piece was a curve starting from −0.794 [V vs. Ag—AgCl] (i.e., the spontaneous potential $SP_{Al}$ value on the horizontal axis of the P-d graph) and extending toward lower potential than this value and in a direction in which the current density increases.

Similarly, an anode polarization curve $APC_{22\%\ Ni\text{-}78\%\ Zn}$ of the Ni—Zn alloy test piece of 22% Ni and 78% Zn by mass was a curve starting from −0.672 [V vs. Ag—AgCl] (i.e., the spontaneous potential $SP_{22\%\ Ni\text{-}78\%\ Zn}$ value on the horizontal axis of the P-d graph) and extending toward higher potential than this value and in a direction in which the current density increases. Meanwhile, a cathode polarization curve $CPC_{22\%\ Ni\text{-}78\%\ Zn}$ thereof was a curve starting from −0.672 [V vs. Ag—AgCl] (i.e., the spontaneous potential $SP_{22\%\ Ni\text{-}78\%\ Zn}$ value on the horizontal axis of the P-d graph) and extending toward lower potential than this value and in a direction in which the current density increases.

(Calculations of Corrosion Density and Aluminum Corrosion Rate)

As described above, the pure Al test piece had a spontaneous potential $SP_{Al}$ of −0.794 [V vs. Ag—AgCl] and was more base metal than the Ni—Zn alloy test piece of 22% Ni and 78% Zn by mass having a spontaneous potential $SP_{22\%\ Ni\text{-}78\%\ Zn}$ of −0.672 [V vs. Ag—AgCl]. Hence, on the P-d graph, the anode polarization curve $APC_{Al}$ of the pure Al test piece starting from the spontaneous potential $SP_{Al}$ of the pure Al test piece on the horizontal axis and extending toward higher potential intersects, and has an intersection point IP, with the cathode polarization curve $CPC_{22\%\ Ni\text{-}78\%\ Zn}$ of the Ni—Zn alloy test piece of 22% Ni and 78% Zn by mass starting from the spontaneous potential $SP_{22\%\ Ni\text{-}78\%\ Zn}$ of the Ni—Zn alloy test piece on the horizontal axis and extending toward lower potential. A current density $D_{IP}$ [$A/cm^2$] at this intersection point IP between $APC_{Al}$ and $CPC_{22\%\ Ni\text{-}78\%\ Zn}$ is a corrosion current density of galvanic corrosion between the pure Al test piece and the Ni—Zn alloy test piece of 22% Ni and 78% Zn by mass. Moreover, from the corrosion current density, a charge amount per unit time required for aluminum corrosion is calculated. An aluminum corrosion rate [μg/year] can be calculated using: the charge amount per unit time, the half reaction equation $Al \rightarrow Al^{3+}+3e^-$ of the anodic reaction of aluminum, the Faraday constant, and the density of aluminum.

In this manner, the corrosion current density and the aluminum corrosion rate [μg/year] were calculated for the galvanic corrosion between the pure Al test piece and the Ni—Zn alloy test piece of 22% Ni and 78% Zn by mass of Example 1. As a result of the calculations, the corrosion current density was $1.70\times10^{-6}$ [A/cm$^2$], and the aluminum corrosion rate was $3.12\times10^4$ [μg/year]. The aluminum corrosion rate is indicated by "Example 1" in FIG. 5. Note that "Zn content," the title of the horizontal axis in FIG. 5, indicates a Zn content in the Ni—Zn alloy. For example, a Zn content of 78% by mass in FIG. 5 indicates a Ni—Zn alloy of 22% Ni and 78% Zn by mass.

Figure 6:
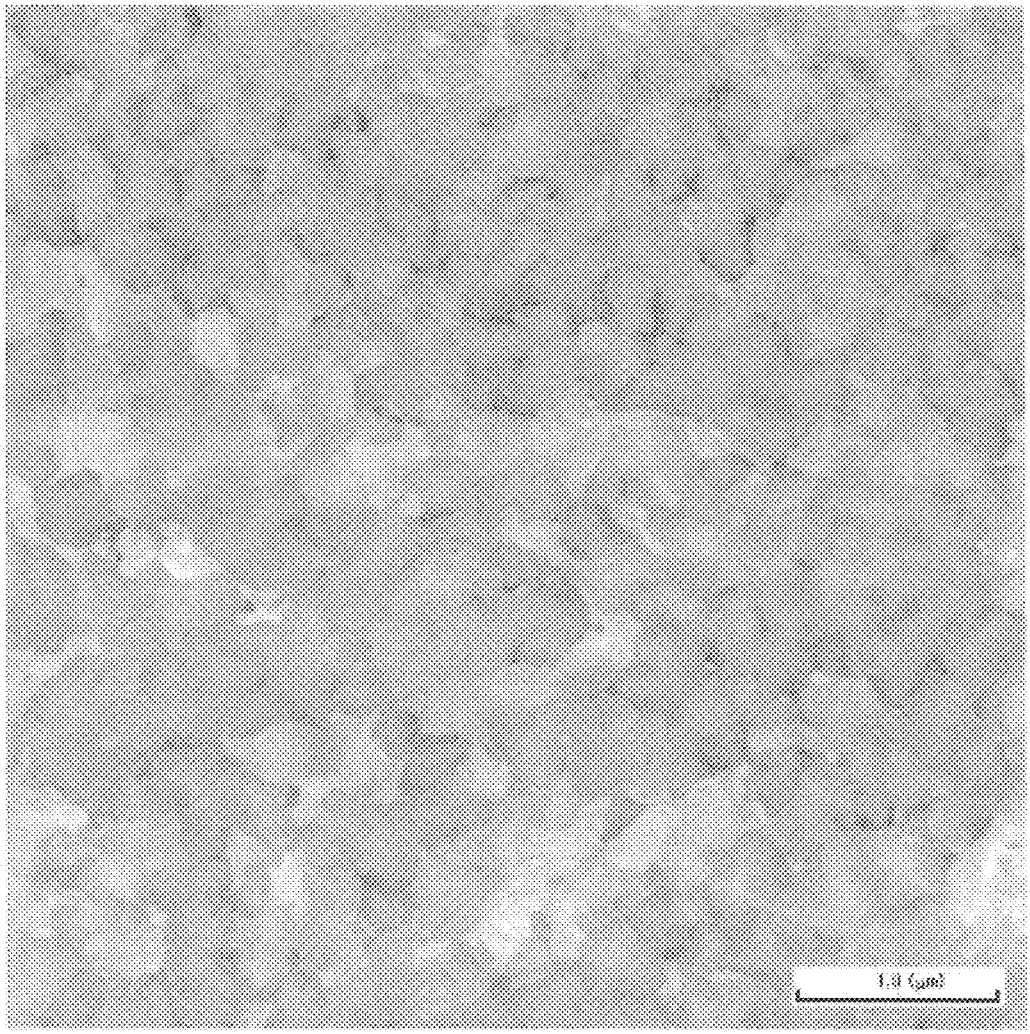
FIG. 6 is an exemplary optical micrograph of the surface of an anticorrosive plating layer in Example 1.

The surface of the anticorrosive plating layer 32 of Example 1 was observed by scanning ion microscopy (SIM). FIG. 6 shows the result. It was found out from FIG. 6 that the Ni—Zn alloy of 22% Ni and 78% Zn by mass constituting the anticorrosive plating layer 32 had small crystal grains. It is conceivable from FIG. 6 that, in the anticorrosive plating layer 32 of Example 1, the fine crystal grains increased the area of the grain boundaries, thereby caused grain boundary scattering and increased the electrical resistance, consequently decreasing the galvanic corrosion current and suppressing the corrosion.

Comparative Example 1

(Preparation of Crimp-Terminal Main Body)

The same crimp-terminal main body 31 made of pure copper as that in Example 1 was prepared.

(Preparation of Plating Bath)

A zinc-containing Watts bath as a plating bath was prepared in the same manner as in Example 1, except that the composition of the plating bath was changed as shown in Table 1. The zinc-containing Watts bath of Comparative Example 1 was determined such that when an anticorrosive plating layer was formed by plating the crimp-terminal main body made of pure copper under the electrolysis conditions shown in Table 1, the Mass ratio of Zn—Ni constituting the obtained anticorrosive plating layer took values (i.e., 82% Ni and 18% Zn by mass shown in the column of Comparative Example 1 in Table 1.

(Formation of Anticorrosive Plating Layer)

An anticorrosive plating layer was formed on the crimp-terminal main body 31 and a crimp terminal was obtained in the same manner as in Example 1, except that the electrolysis conditions were changed as shown in Table 1. The anticorrosive plating layer had a thickness of 2 μm.

(Evaluation of Anticorrosive Plating Layer)

(Composition of Anticorrosive Plating Layer)

The obtained anticorrosive plating layer was analyzed for the elemental composition in the same manner as in Example 1. As a result, the material of the anticorrosive plating layer was a Ni—Zn alloy of 82% Ni and 18% Zn by mass. Table 1 shows the measurement result.

(Formation of Terminal-Equipped Electrical Wire)

The terminal-equipped electrical wire 1 shown in FIG. 1 was prepared in the same manner as in Example 1.

(Aluminum Corrosion Rate in Galvanic Corrosion of Terminal-Equipped Electrical Wire)

A spontaneous potential $SP_{82\%\ Ni\text{-}18\%\ Zn}$ of a Ni—Zn alloy test piece of 82% Ni and 18% Zn by mass was measured in the same manner as in Example 1, except that the Ni—Zn alloy test piece of 82% Ni and 18% Zn by mass was used in place of the Ni—Zn alloy test piece of 22% Ni and 78% Zn by mass of Example 1. An anode polarization curve $APC_{82\%\ Ni\text{-}18\%\ Zn}$ and a cathode polarization curve $CPC_{82\%\ Ni\text{-}18\%\ Zn}$ of the Ni—Zn alloy test piece of 82% Ni and 18% Zn by mass were obtained.

(Measurement of Spontaneous Potential)

The Ni—Zn alloy test piece had a spontaneous potential $SP_{82\%\ Ni\text{-}18\%\ Zn}$ of −0.217 [V vs. Ag—AgCl].

(Creation of Polarization Curves)

The anode polarization curve $APC_{82\%\ Ni\text{-}18\%\ Zn}$ of the Ni—Zn alloy test piece of 82% Ni and 18% Zn by mass was a curve starting from −0.217 [V vs. Ag—AgCl] (i.e., the spontaneous potential $SP_{82\%\ Ni\text{-}18\%\ Zn}$ value on the horizontal axis of the P-d graph) and extending toward higher potential than this value and in a direction in which the current density increases. Meanwhile, the cathode polarization curve $CPC_{82\%\ Ni\text{-}18\%\ Zn}$ was a curve starting from −0.217 [V vs. Ag—AgCl] (i.e., the spontaneous potential $SP_{82\%\ Ni\text{-}18\%\ Zn}$ value on the horizontal axis of the P-d graph) and extending toward lower potential than this value and in a direction in which the current density increases.

(Calculations of Corrosion Current Density and Aluminum Corrosion Rate)

As described above, the pure Al test piece had a spontaneous potential $SP_{Al}$ of −0.794 [V vs. Ag—AgCl] and was more base metal than the Ni—Zn alloy test piece of 82% Ni and 18% Zn by mass having a spontaneous potential $SP_{82\%\ Ni\text{-}18\%\ Zn}$ of −0.217 [V vs. Ag—AgCl]. Hence, on the P-d graph, the anode polarization curve $APC_{Al}$ of the pure Al test piece starting from the spontaneous potential $SP_{Al}$ of the pure Al test piece on the horizontal axis and extending toward higher potential intersects, and has an intersection point IP, with the cathode polarization curve $CPC_{82\%\ Ni\text{-}18\%\ Zn}$ of the Ni—Zn alloy test piece of 82% Ni and 18% Zn by mass starting from the spontaneous potential $SP_{82\%\ Ni\text{-}18\%\ Zn}$ of the Ni—Zn alloy test piece on the horizontal axis and extending toward lower potential. A current density $D_{IP}$ [A/cm$^2$] at this intersection point IP between. $APC_{Al}$ and $CPC_{82\%\ Ni\text{-}18\%\ Zn}$ is a corrosion current density of galvanic corrosion between the pure Al test piece and the Ni—Zn alloy test piece of 82% Ni and 18% Zn by mass. Moreover, from the corrosion current density, an aluminum corrosion rate [μg/year] can be calculated in the same manner as in Example 1.

In this manner, the corrosion current density and the aluminum corrosion rate [μg/year] were calculated for the galvanic corrosion between the pure Al test piece and the Ni—Zn alloy test piece of 82% Ni and 18% Zn by mass of Comparative Example 1. As a result of the calculations, the corrosion current density was $2.01\times10^{-5}$ [A/cm$^2$], and the aluminum corrosion rate was $3.70\times10^5$ [μg/year]. The aluminum corrosion rate is indicated by "Comparative Example 1" in FIG. 5.

Comparative Example 2

(Preparation of Crimp-Terminal Main Body)

The same crimp-terminal main body 31 made of pure copper as that in Example 1 was prepared.

(Preparation of Plating Bath)

A zinc-containing Watts bath as a plating bath was prepared in the same manner as in Example 1, except that the composition of the plating bath was changed as shown in Table 1. The zinc-containing Watts bath of Comparative Example 2 was determined such that when an anticorrosive plating layer was formed by plating the crimp-terminal main body made of pure copper under the electrolysis conditions shown in Table 1, the mass ratio of Zn—Ni constituting the obtained anticorrosive plating layer took values (i.e., 93% Ni and 7% Zn by mass) shown in the column of Comparative Example 2 in Table 1.

(Formation of Anticorrosive Plating Layer)

An anticorrosive plating layer was formed on the crimp-terminal main body 31 and a crimp terminal was obtained in the same manner as in Example 1, except that the electrolysis conditions were changed as shown in Table 1. The anticorrosive plating layer had a thickness of 2 μm.

(Evaluation of Anticorrosive Plating Layer)

(Composition of Anticorrosive Plating Layer)

The obtained anticorrosive plating layer was analyzed for the elemental composition in the same manner as in Example 1. As a result, the material of the anticorrosive plating layer was a Ni—Zn alloy of 93% Ni and 7% Zn by mass. Table 1 shows the measurement result.

(Formation of Terminal-Equipped Electrical Wire)

The terminal-equipped electrical wire 1 shown in FIG. 1 was prepared in the same manner as in Example 1.

(Aluminum Corrosion Rate in Galvanic Corrosion of Terminal-Equipped Electrical Wire)

A spontaneous potential $SP_{93\%\ Ni\text{-}7\%\ Zn}$ of a Ni—Zn alloy test piece of 93% Ni and 7% Zn by mass was measured in the same manner as in Example 1, except that the Ni—Zn alloy test piece of 93% Ni and 7% Zn by mass was used in place of the Ni—Zn alloy test piece of 22% Ni and 78% Zn by mass of Example 1. An anode polarization curve $APC_{93\%\ Ni\text{-}7\%\ Zn}$ and a cathode polarization curve $CPC_{93\%\ Ni\text{-}7\%\ Zn}$ of the Ni—Zn alloy test piece of 93% Ni and 7% Zn by mass were obtained.

(Measurement of Spontaneous Potential)

The Ni—Zn alloy test piece had a spontaneous potential $SP_{93\%\ Ni\text{-}7\%\ Zn}$ of −0.188 [V vs. Ag—AgCl].

(Creation of Polarization Curves)

The anode polarization curve $APC_{93\%\ Ni\text{-}7\%\ Zn}$ of the Ni—Zn alloy test piece of 93% Ni and 7% Zn by mass was a curve starting from −0.188 [V vs. Ag—AgCl] (i.e., the spontaneous potential $SP_{93\%\ Ni\text{-}7\%\ Zn}$ value on the horizontal axis of the P-d graph) and extending toward higher potential than this value and in a direction in which the current density increases. Meanwhile, the cathode polarization curve $CPC_{93\%\ Ni\text{-}7\%\ Zn}$ was a curve starting from −0.188 [V vs. Ag—AgCl] (i.e., the spontaneous potential $SP_{93\%\ Ni\text{-}7\%\ Zn}$ value on the horizontal axis of the P-d graph) and extending toward lower potential than this value and in a direction in which the current density increases.

(Calculations of Corrosion Current Density and Aluminum Corrosion Rate)

As described above, the pure Al test piece had a spontaneous potential $SP_{Al}$ of −0.794 [V vs. Ag—AgCl] and was more base metal than the Ni—Zn alloy test piece of 93% Ni and 7% Zn by mass having a spontaneous potential $SP_{93\%\ Ni\text{-}7\%\ Zn}$ of −0.188 [V vs. Ag—AgCl]. Hence, on the P-d graph, the anode polarization curve $APC_{Al}$ of the pure Al test piece starting from the spontaneous potential $SP_{Al}$ of the pure Al test piece on the horizontal axis and extending toward higher potential intersects, and has an intersection point IP, with the cathode polarization curve $CPC_{93\%\ Ni\text{-}7\%\ Zn}$ of the Ni—Zn alloy test piece of 93% Ni and 7% Zn by mass starting from the spontaneous potential $SP_{93\%\ Ni\text{-}7\%\ Zn}$ of the Ni—Zn alloy test piece on the horizontal axis and extending toward lower potential. A current density $D_{IP}$ [A/cm$^2$] at this intersection point IP between $APC_{Al}$ and $CPC_{93\%\ Ni\text{-}7\%\ Zn}$ is a corrosion current density of galvanic, corrosion between the pure Al test piece and the Ni—Zn alloy test piece of 93% Ni and 7% Zn by mass. Moreover, from the corrosion current density, an aluminum corrosion rate [μg/year] can be calculated in the same manner as in Example 1.

In this manner, the corrosion current density and the aluminum corrosion rate [μg/year] were calculated for the galvanic corrosion between the pure Al test piece and the Ni—Zn alloy test piece of 93% Ni and 7% Zn by mass of Comparative Example 2. As a result of the calculations, the corrosion current density was $2.11\times10^{-5}$ [A/cm$^2$], and the aluminum corrosion rate was $3.88\times100^{5}$ [μg/year]. The aluminum corrosion rate is indicated by "Comparative Example 2" in FIG. 5.

Comparative Example 3

(Preparation of Crimp-Terminal Main Body)

The same crimp-terminal main body 31 made of pure copper as that in Example 1 was prepared.

(Preparation of Plating Bath)

A Watts bath containing no metal zinc was prepared in the same manner as in Example 1, except that the composition of the plating bath was changed as shown in Table 1. Table 1 shows the composition of the plating bath.

(Formation of Anticorrosive Plating Layer)

An anticorrosive plating layer was formed on the crimp-terminal main body 31 and a crimp terminal was obtained in the same manner as in Example 1, except that the electrolysis conditions were changed as shown in Table 1. The anticorrosive plating layer had a thickness of 2 μm.

(Evaluation of Anticorrosive Plating Layer)

(Composition of Anticorrosive Plating Layer)

The obtained anticorrosive plating layer was analyzed for the elemental composition in the same manner as in Example 1. As a result, the material of the anticorrosive plating layer was Ni, that is, 100% Ni by mass. Table 1 shows the measurement result.

(Formation of Terminal-Equipped Electrical Wire)

The terminal-equipped electrical wire 1 shown in FIG. 1 was prepared in the same manner as in Example 1.

(Aluminum Corrosion Rate in Galvanic Corrosion of Terminal-Equipped Electrical Wire)

A spontaneous potential $SP_{Ni}$ of a pure Ni test piece of 100% Ni by mass was measured in the same manner as in Example 1, except that the pure Ni test piece of 100% Ni by mass was used in place of the Ni—Zn alloy test piece of 22% Ni and 78% Zn by mass of Example 1. An anode polarization curve $APC_{Ni}$ and a cathode polarization curve $CPC_{Ni}$ of the pure Ni test piece of 100% Ni by mass were obtained.

(Measurement of Spontaneous Potential)

The pure Ni test piece had a spontaneous potential $SP_{Ni}$ of −0.105 [V vs. Ag—AgCl].

(Creation of Polarization Curves)

The anode polarization curve $APC_{Ni}$ of the pure Ni test piece of 100% Ni by mass was a curve starting from −0.105 [V vs. Ag—AgCl] (i.e., the spontaneous potential $SP_{Ni}$ value on the horizontal axis of the P-d graph) and extending toward higher potential than this value and in a direction in which the current density increases. Meanwhile, the cathode polarization curve $CPC_{Ni}$ was a curve starting from −0.105 [V vs. Ag—AgCl] (i.e., the spontaneous potential $SP_{Ni}$ value on the horizontal axis of the P-d graph) and extending toward lower potential than this value and in a direction in which the current density increases.

(Calculations of Corrosion Current Density and Aluminum Corrosion Rate)

As described above, the pure Al test piece had a spontaneous potential $SP_{Al}$ of −0.794 [V vs. Ag—AgCl] and was more base metal than the pure Ni test piece of 100% Ni by mass having a spontaneous potential $SP_{Ni}$ of −0.105 [V vs. Ag—AgCl]. Hence, on the P-d graph, the anode polarization curve $APC_{Al}$ of the pure Al test piece starting from the spontaneous potential $SP_{Al}$ of the pure Al test piece on the horizontal axis and extending toward higher potential intersects, and has an intersection point IP, with the cathode polarization curve $CPC_{Ni}$ of the pure Ni test piece of 100% Ni by mass starting from the spontaneous potential $SP_{Ni}$ of the pure Ni test piece on the horizontal axis and extending toward lower potential. A current density $D_{IP}$ [A/cm$^2$] at this intersection point IP between $APC_{Al}$ and $CPC_{Ni}$ is a corrosion current density of galvanic corrosion between the pure Al test piece and the pure Ni test piece. Moreover, from the corrosion current density, an aluminum corrosion rate [μg/year] can be calculated in the same manner as in Example 1.

In this manner, the corrosion current density and the aluminum corrosion rate [μg/year] were calculated for the galvanic corrosion between the pure Al test piece and the pure Ni test piece of 100% Ni by mass of Comparative Example 3. As a result of the calculations, the corrosion current density was $1.07\times10^{-5}$ [A/cm$^2$], and the aluminum corrosion rate was $1.97\times10^{5}$ [μg/year].

Figure 7:
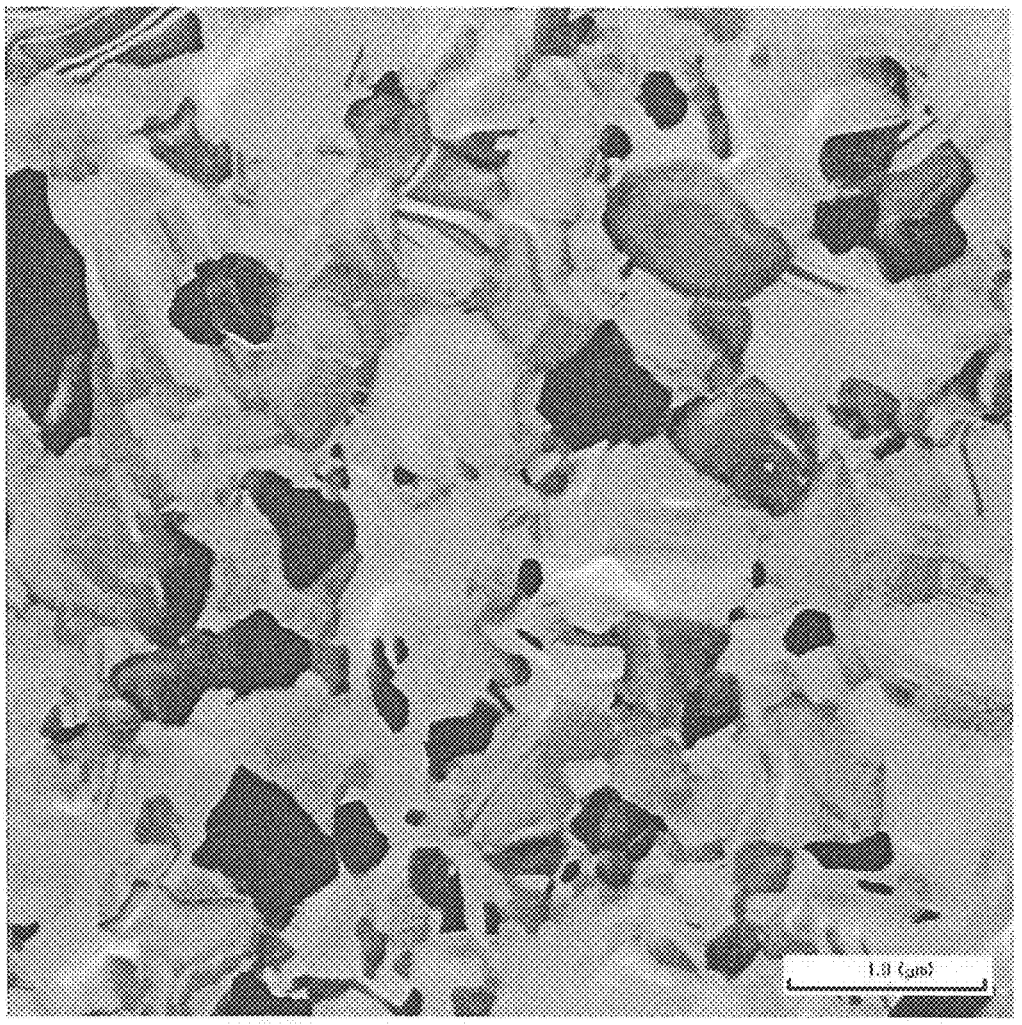
FIG. 7 is another exemplary optical micrograph of the surface of an anticorrosive plating layer in Reference Example 1.

The surface of the anticorrosive plating layer 32 of Comparative Example 3 was observed by scanning ion microscopy (SIM). FIG. 7 shows the result. It was found out from FIG. 7 that the pure Ni, that is, 100% Ni by mass, constituting the anticorrosive plating layer 32 had large crystal grains.

Reference Example 1

(Aluminum Corrosion Rate in Galvanic Corrosion of Tin-Plated Copper)

Galvanic corrosion of a conventional crimp terminal was imitated in which the surface of the crimp-terminal main body 31 made of pure copper was plated with tin. A pure Sn test piece was used to measure a spontaneous potential and create polarization curves. Then, an aluminum corrosion rate in galvanic corrosion was calculated using the polarization curves of the pure Sn test piece and the pure Al test piece of Example 1. Specifically, a spontaneous potential $SP_{Sn}$ of the pure Sn test piece of 100% Sn by mass was measured in the same manner as in Example 1, except that the pure Sn test piece of 100% Sn by mass was used in place of the Ni—Zn alloy test piece of 22% Ni and 78% Zn by mass of Example 1. An anode polarization curve $APC_{Sn}$ and a cathode polarization curve $CPC_{Sn}$ were obtained.

(Measurement of Spontaneous Potential)

The pure Sn test piece had a spontaneous potential $SP_{Sn}$ of −0.35 [V vs. Ag—AgCl].

(Creation of Polarization Curves)

The anode polarization curve $APC_{Sn}$ of the pure Sn test piece of 100% Sn by mass was a curve starting from −0.35 [V vs. Ag—AgCl] (i.e., the spontaneous potential $SP_{Sn}$ value on the horizontal axis of the P-d graph) and extending toward higher potential than this value and in a direction in which the current density increases. Meanwhile, the cathode polarization curve $CPC_{Sn}$ was a curve starting from −0.35 [V vs. Ag—AgCl] (i.e., the spontaneous potential $SP_{Sn}$ value on the horizontal axis of the P-d graph) and extending toward lower potential than this value and in a direction in which the current density increases.

(Calculations of Corrosion Current Density and Aluminum Corrosion Rate)

As described above, the pure Al test piece had a spontaneous potential $SP_{Al}$ of −0.794 [V vs. Ag—AgCl] and was more base metal than the pure Sn test piece of 100% Sn by mass having a spontaneous potential $SP_{Sn}$ value of −0.35 [V vs. Ag—AgCl]. Hence, on the P-d graph, the anode polarization curve $APC_{Al}$ of the pure Al test piece starting from the spontaneous potential $SP_{Al}$ of the pure Al test piece on the horizontal axis and extending toward higher potential intersects, and has an intersection point IP, with the cathode polarization curve $CPC_{Sn}$ of the pure Sn test piece of 100% Sn by mass starting from the spontaneous potential $SP_{Sn}$ of the pure Sn test piece on the horizontal axis and extending toward lower potential. A current density $D_{IP}$ [A/cm$^2$] at this intersection point IP between $APC_{Al}$ and $CPC_{Sn}$ is a corrosion current density of galvanic corrosion between the pure Al test piece and the pure Sn test piece. Moreover, from the corrosion current density, an aluminum corrosion rate [μg/year] can be calculated in the same manner as in Example 1.

In this manner, the corrosion current density and the aluminum corrosion rate [μg/year] were calculated for the galvanic corrosion between the pure Al test piece and the pure Sn test piece of 100% Sn by mass of Reference Example 1. As a result of the calculations, the corrosion current density was $4.53\times10^{-6}$ [A/cm$^2$], and the aluminum corrosion rate was $8.32\times10^{4}$ [μg/year]. The aluminum corrosion rate is indicated by "Reference Example 1" in FIG. 5.

Figure 5:
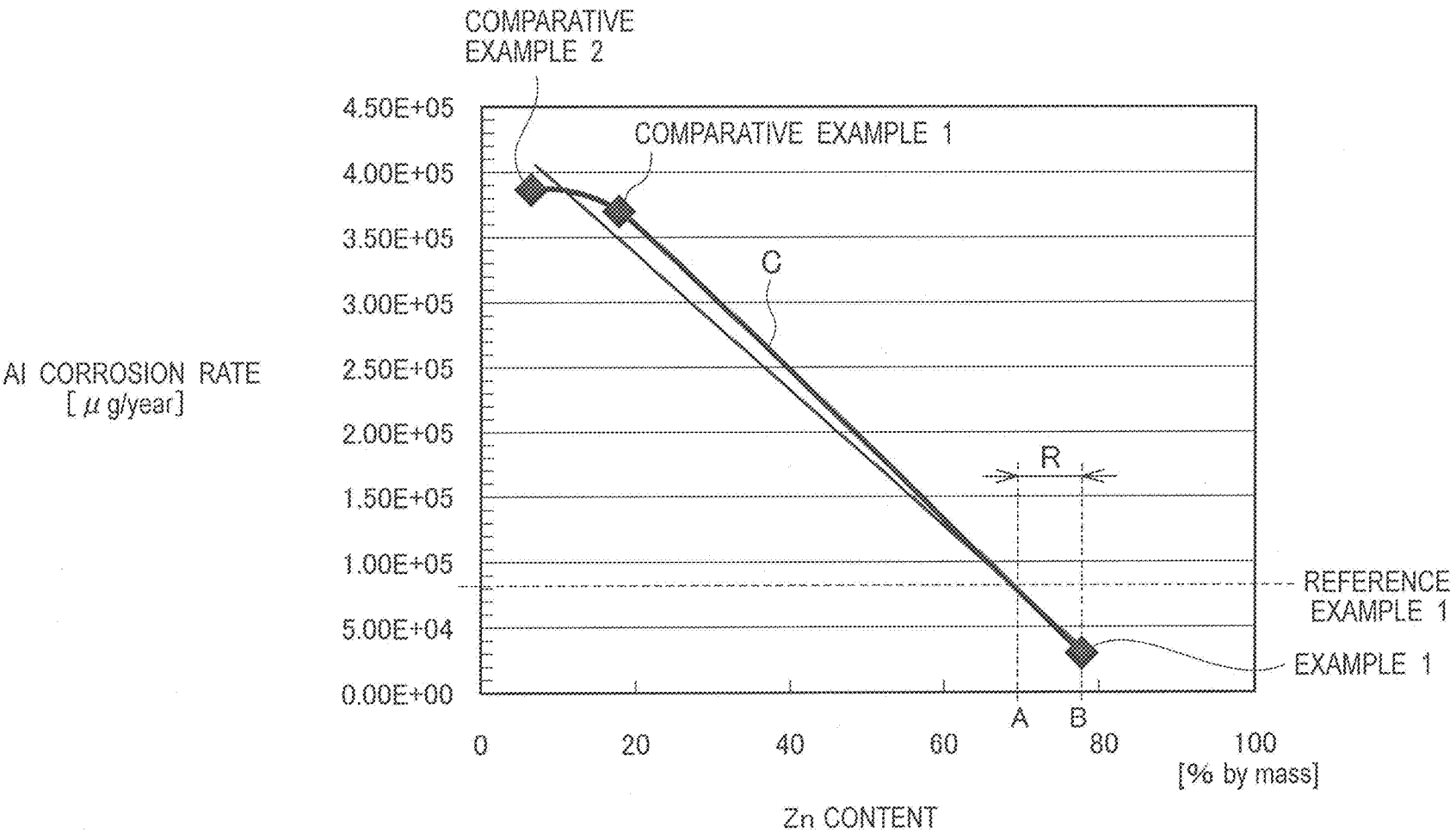
FIG. 5 is a graph showing a relation between the composition of an anticorrosive plating layer of the crimp terminal and the corrosion rate of Al, which is a material of the electrical wire.

As described above, a total of three aluminum corrosion rates are plotted in FIG. 5 for each of Example 1 (22% Ni and 78% Zn by mass), Comparative Example 1 (82% Ni and 18% Zn by mass), and Comparative Example 2 (93% Ni and 7% Zn by mass), which differ from each other in the element proportions of the Ni—Zn alloy. Then, a fitted curve C connecting these three points was created. This fitted curve C is represented by $y=-5230.5x+442512$, where x represents a Zn content [% by mass] on the horizontal axis of FIG. 5, and y represents an Al corrosion rate [μg/year] on the vertical axis. FIG. 5 shows the fitted curve C.

Next, the fitted curve C was compared with the aluminum corrosion rate of $8.32\times10^{4}$ [μg/year] of Reference Example 1 to calculate a range in the fitted curve C, where the corrosion rate is lower than the aluminum corrosion rate of Reference Example 1. The result revealed that, in a range of x from 69% by mass to 78% by mass in the fitted curve C (i.e., a range R between A % by mass and B % by mass in FIG. 5), the aluminum corrosion rate of the Ni—Zn alloy is lower than the aluminum corrosion rate of Reference Example 1. This indicates that a crimp terminal in which an anticorrosive plating layer is formed on a surface of a crimp-terminal main body by using a Ni—Zn alloy having a composition in a range from 31% Ni and 69% Zn by mass to 22% Ni and 78% Zn by mass has a lower aluminum corrosion rate than a conventional crimp terminal having a tin-plated surface.

Hereinabove, the present invention has been described by way of the embodiments. However, the present invention is not limited thereto, and various modifications can be made without departing from the spirit of the present invention.

What is claimed is:

1. A terminal-equipped electrical wire comprising:

an electrical wire having a conductor and an electrical-wire coating member covering the conductor; and a crimp terminal having a crimp-terminal main body electrically connected to the conductor of the electrical wire, and an anticorrosive plating layer provided to a portion of a surface of the crimp-terminal main body, the portion being in contact with at least the conductor of the electrical wire, wherein the conductor is made of aluminum or an aluminum alloy, and the anticorrosive plating layer is made of a Ni—Zn alloy having a Zn content of 69 to 78% by mass such that fine crystal grains of the Ni—Zn alloy are produced to increase an area of grain boundaries in the anticorrosive plating layer.

2. The terminal-equipped electrical wire according to claim 1, wherein the crimp-terminal main body is made of at least one selected from the group consisting of copper, copper alloys, and stainless steels.

3. A wire harness comprising the terminal-equipped electrical wire according to claim 1.

4. The terminal-equipped electrical wire according to claim 1, wherein a material of the electrical-wire coating member comprises an insulating resin.

5. The terminal-equipped electrical wire according to claim 4, wherein a main component of the material of the electrical-wire coating member comprises at least one selected from the group consisting of a polyethylene (PE), a polypropylene (PP), an ethylene copolymer, and a propylene copolymer, and a polyvinyl chloride (PVC).

6. The terminal-equipped electrical wire according to claim 1, wherein the crimp terminal comprises a female crimp terminal.

7. The terminal-equipped electrical wire according to claim 1, wherein the crimp-terminal main body of the crimp terminal comprises an electrical connector having a box shape and includes a spring piece configured to engage with a counterpart terminal.

8. The terminal-equipped electrical wire according to claim 1, wherein the anticorrosive plating layer is configured to suppress a galvanic corrosion between the crimp-terminal main body and the conductor of the electrical wire.

9. The terminal-equipped electrical wire according to claim 8, wherein the anticorrosive plating layer is configured to suppress a dissolution of the aluminum or the aluminum alloy from the conductor of the electrical wire due to the galvanic corrosion.

10. The terminal-equipped electrical wire according to claim 1, wherein the anticorrosive plating layer is provided to all surfaces of the crimp-terminal main body that face the conductor of the electrical wire.

11. The terminal-equipped electrical wire according to claim 1, wherein the fine crystal grains are produced to cause grain boundary scattering to increase an electrical resistance and reduce a galvanic corrosion current in order to suppress the galvanic corrosion.

12. The terminal-equipped electrical wire according to claim 1, wherein the fine crystal grains comprise an average crystal grain size of from 0.1 μm to 0.7 μm.

13. The terminal-equipped electrical wire according to claim 1, wherein the fine crystal grains comprise an average crystal grain size of from 0.2 μm to 0.5 μm.

14. The wire harness according to claim 3, further comprising a connector.

15. The wire harness according to claim 14, wherein the connector comprises a back surface side capable of being connected to multiple counterpart terminals.

16. The wire harness according to claim 14, wherein the connector comprises a front surface side provided with multiple cavities, and the crimp terminal of the terminal-equipped electrical wire is to be attached to one of the multiple cavities.

17. The wire harness according to claim 16, wherein each of the multiple cavities comprises a substantially rectangular opening slightly larger than a cross section of the crimp terminal of the terminal-equipped electrical wire.

18. The wire harness according to claim 16, wherein in a condition in which the crimp terminal of the terminal-equipped electrical wire is attached to one of the multiple cavities of the connector, the electrical wire leads out from the front surface side of the connector.

* * * * *